US005444957A

United States Patent [19]

Roberts

[11] Patent Number: 5,444,957

[45] Date of Patent: Aug. 29, 1995

[54] MULTISTORY SLAB CONSTRUCTION

[76] Inventor: Walter R. Roberts, 709 N. Florida St., Arlington, Va. 22205

[21] Appl. No.: 190,359

[22] Filed: Feb. 1, 1994

[51] Int. Cl.[6] ..... E04B 1/16

[52] U.S. Cl. ..... 52/745.05; 52/745.09; 52/745.17; 52/745.03; 52/236.8; 52/259

[58] Field of Search ..... 52/743, 745.05, 745.09, 52/745.12, 745.17, 745.02, 745.03, 79.14, 236.9, 236.7, 236.8, 253, 259

[56] References Cited

U.S. PATENT DOCUMENTS

| | | | |
|---|---|---|---|
| 3,543,457 | 12/1970 | Budlong . | |
| 3,613,325 | 10/1971 | Yee | 52/236.8 |
| 3,867,805 | 2/1975 | Mikami et al. | 52/259 X |
| 3,973,366 | 8/1976 | Balane et al. | 52/745.05 X |
| 4,074,487 | 2/1978 | Daniels et al. | 52/745.12 X |
| 4,074,493 | 2/1978 | Outram . | |
| 4,099,360 | 7/1978 | Outram . | |
| 4,202,378 | 5/1980 | Bush et al. . | |
| 4,222,269 | 12/1983 | Giard . | |
| 4,434,600 | 3/1984 | Backman . | |
| 4,598,517 | 7/1986 | Alvarsson . | |
| 4,612,747 | 9/1986 | Andra et al. . | |
| 4,619,096 | 10/1986 | Lancelot, III . | |
| 4,785,593 | 11/1988 | Munoz, Jr. | 52/745.17 X |
| 5,065,558 | 11/1991 | Boatsman . | |
| 5,079,890 | 1/1992 | Kubik et al. . | |

*Primary Examiner*—Carl D. Friedman
*Assistant Examiner*—Kien T. Nguyen
*Attorney, Agent, or Firm*—Richard C. Litman

[57] ABSTRACT

A method of building multistory structures having poured concrete slabs. Vertical structural columns and other nonstructural members penetrating the finished floor slabs are terminated at each floor below the level of the finished slab. The slab is then poured, covering the terminated structural and nonstructural members with a thin layer of concrete, and leaving an upper slab surface unencumbered by upward projections. The entire slab is then screeded by a screeding machine in one pass. In an alternative embodiment, the screeding machine makes more than one pass, but the upper surface is still unobstructed. The thin layer of concrete is readily discerned by coloration differences, and is chipped away and removed. All penetrating members are then extended. The process is repeated until all slabs are completed. The novel method is usable with both steel and poured concrete columns. In alternative embodiments, connectors enabling connection of subsequent column members, such as I-beams and rebar, are provided and protected, as by covering with frangible caps, from poured concrete. By reducing total frame construction time and screeding labor, the novel method is more economically advantageous with greater numbers of floors.

15 Claims, 4 Drawing Sheets

MULTISTORY SLAB CONSTRUCTION

BACKGROUND OF THE INVENTION

1. FIELD OF THE INVENTION

The present invention relates to a method of erecting the frame or skeleton of and constructing poured concrete floor slabs of a multistory structure.

2. DESCRIPTION OF THE PRIOR ART

Construction of large scale structures having poured concrete slabs is a very expensive and somewhat time consuming undertaking. As an example, the step of screeding or finishing of slabs, requires specialized equipment. In the field of roadways and bridges having concrete slabs, the scale of operation has justified screeding apparatus which rides on wheels, spanning the width of the slab, proceeding from one end of a section of poured slab to the opposite end.

Construction of multistory structures having frames or skeletons including vertical columns departs from this practice, since the columns and other members penetrating floor slabs requires that those screeding the slab work around these obstructions. Generally, these obstructions are avoided, where feasible, to reduce the time consuming work of screeding or finishing small areas around the obstructions. However, overall processes of and approaches to constructing multistory slab structures have not been influenced by improving the efficiency of slab formation and finishing.

A small scale practice relating to this concept is commonly found in single unit residential construction. When providing a roughed in bath, the watercloset plumbing is generally set in place in the ground, capped, and the floor of the watercloset is poured thereover. The concrete layer covering the cap is removed, a toilet is set in place thereover, and connected to the roughed in plumbing. The floor can be screeded without working around an obstruction arising from this plumbing. It should be noted that while the screeder has removed one obstacle, the subsequent screeding is generally still performed by hand. Also, only one obstacle has been dealt with in this manner, and others remain. Beyond these points, the object placed above the exposed plumbing is an appliance, and not a structural member of the residential unit.

The following references provide examples of individual features of the novel method, but these occur outside the context of the novel method.

U.S. Pat. No. 5,079,890, issued to Marian L. Kubik et al. on Jan. 14, 1992, illustrates a concrete slab member having an upper surface undisturbed by protrusion of structural members. This slab member is a self-contained member cooperating with other coplanar members. This reference teaches away from the concept of providing a single, continuous slab member of a building, in that there are other members present, all members collectively defining an upper surface. Furthermore, there is no contemplation of extending a vertical support member through the poured slab.

U.S. Pat. No. 4,598,517, issued to Yngve Alvarsson on Jul. 8, 1986, discloses the use of ring like spacers placed around members projecting through a poured concrete floor. The spacer has two fold significance. The first is that a structural beam passing through the concrete floor need not contact the floor, thus imposing load or weight stresses thereto, which would, in time, cause the floor to crack. The spacer provides a sleeve defining a penetration through the new slab.

The second purpose, of greater importance to the present invention, is to provide continuity to a screed support member which is interrupted by the presence of the same beam. It is important to note that the spacer accommodates the beam, and the beam remains in place., projecting through the plane of the finished floor slab. Accommodation and acceptance of this projection teach against the method of the present invention.

U.S. Pat. No. 4,434,600, issued to Henrik A. Backman on Mar. 6, 1984, discloses a method for extending a concrete column upwardly by preforming a base for the same. There is little subject matter relevant to the method of the present invention, in that, among other differences, the preformed base of Backman '600 is not related to a floor slab serving the entire corresponding floor level.

U.S. Pat. No. 5,065,558 issued to W. Harley Boatsman on Nov. 19, 1991, discloses another box-like connector (see element 52 of FIG. 5), for enabling convenient extension of a vertical support member. Again, there is no interaction with a floor slab.

U.S. Pat. No. 4,099,360, issued to Christopher David Outram on Jul. 11, 1978, is directed to method and device for extending concrete columns upwardly. Rebar of each column terminates in a threaded socket. A threaded stud connects upper and lower sockets and, hence, columns.

U.S. Pat. No. 4,074,493, issued to Christopher David Outram on Feb. 21, 1978, and U.S. Pat. No. 4,619,096, issued to Harry B. Lancelot, III on Oct. 28, 1986 further discuss the concept of threaded socket connection of rebar.

U.S. Pat. No. 3,543,457, issued to Oscar A. Budlong on Dec. 1, 1970, discloses the use of liners to form knock-outs in a cast concrete vault.

U.S. Pat. No. 4,422,269, issued to Robert L. Giard on Dec. 27, 1983, illustrates an eye cast in place, within a depression, in a product similar to a concrete column.

U.S. Pat. No. 4,202,378, issued to Lyman F. Bush et al. on May 13, 1980, illustrates one type of rebar safety cap for rendering less dangerous rebar extending upwardly from a poured slab. The present invention abolishes such extensions.

U.S. Pat. No. 4,612,747, issued to Wolfhart Andra et al. on Sep. 23, 1986, generally concerns insertions of dowels and the like into aligned cavities in concrete structures, and is of limited relevance to the present invention.

None of the above inventions and patents, taken either singly or in combination, is seen to describe the instant invention as claimed.

SUMMARY OF THE INVENTION

The present invention provides an improvement to the efficiency of constructing a multistory structure having poured horizontal concrete slabs of length and width corresponding nearly to the final floor area. A novel method is disclosed wherein the frame is built one level or story at a time, and a slab providing a floor for that one level is poured and finished. The vertical columns and all floor penetrating members are terminated just below the level of the finished slab, so that the pour covers all columns and penetrations with a thin layer of concrete.

When the concrete has set up to a sufficient degree, the thin layers are immediately recognizable because of subtle coloring differences existing with respect to surrounding portions of slab of full thickness. Being thin, these layers are readily chipped away and removed, thus exposing the column and penetrating member terminations. These columns and penetrating members are then extended as required.

In the case of the vertical columns, these are extended to the succeeding higher level, the previous steps being repeated, until all desired slabs are poured.

A major advantage achieved is that screeding can almost immediately follow pouring and distribution of fresh concrete. Where appropriate, as would be the case wherein high early strength concrete is employed, location and removal of the thin layers may proceed the same day as the first pour. Thus, even a many level building skeleton may be completed more rapidly than when constructed by traditional methods. This will enable significant savings in interest costs to be realized.

A second advantage is that far less labor is required to screed all floors. A conventional screeding machine may be employed in much the same way as is performed in finishing highways and bridges, so that new specialized equipment need not be developed and manufactured. The screeding machine is passed over the pour of one level, and elevated to the next level. When the next level is built and poured, screeding proceeds as soon as is feasible.

It is possible that the novel process be practiced in part. That is, if a building width is greater than the span of the screeding machine, it is possible to screed the floor in strips or other sections, utilizing the novel method in each pass. The slab may then be patched, hand finished, or otherwise restored to provide a constant, flush, finished upper slab surface.

It is also possible that pouring and distribution of concrete may be performed so as to enjoy similar benefits accorded the screeding step, although this is not crucial to the practice of the invention. Also, the finished slab can be more easily treated, as by sealants, taking advantage of the large, unobstructed surface.

Accordingly, it is a principal object of the invention to provide a method of building a multistory, concrete slab structure wherein slabs are finished by screeding machines moving linearly therealong.

It is another object of the invention to provide a method of building a multistory, concrete slab structure which eliminates projections penetrating the slab during concrete finishing operations.

It is a further object of the invention to provide a method of building a multistory, concrete slab structure which expedites completion time of constructing the skeleton and floor slabs.

Still another object of the invention is to provide a method of building a multistory, concrete slab structure which reduces labor to finish the freshly poured concrete slabs.

An additional object of the invention is to provide a method of building a multistory, concrete slab structure which provides expedited extension of truncated vertical columns and slab penetrating members.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
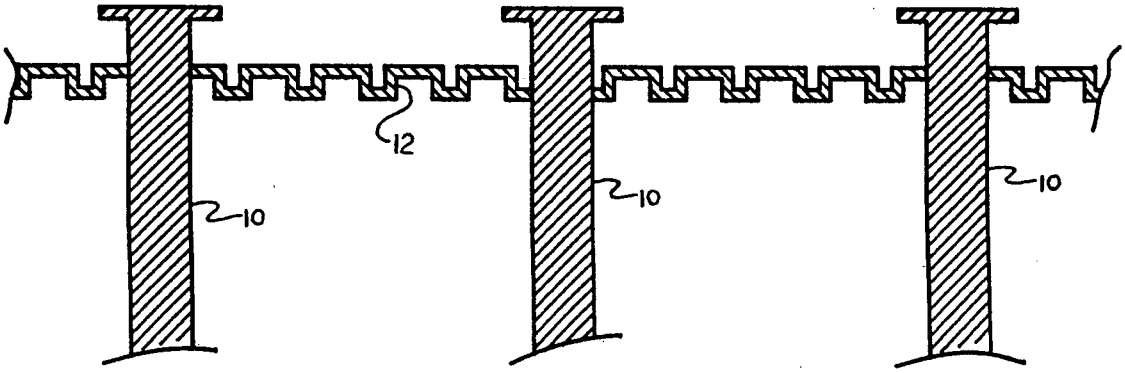
FIG. 1 is a diagrammatic, side cross sectional representation of a structure prepared for slab pouring according to the novel method.

In FIG. 1, a representative floor of a building under construction is shown prepared for pouring of a slab. Vertical structural columns 10 are erected and a concrete retaining element is ready to accept poured concrete. The retaining element actually illustrated is a stepped metal sheet 12, but wooden forms or still other apparatus for retaining fluent concrete in place will be understood to serve in place of metal sheet 12.

Figure 2:
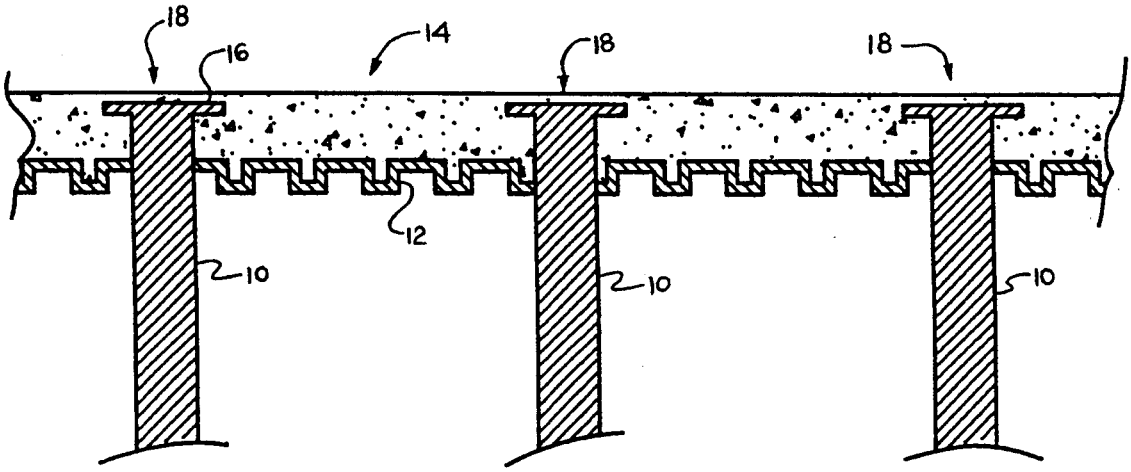
FIG. 2 is the view of FIG. 1, shown after pouring of the slab.

Turning to FIG. 2, the elements of FIG. 1 are shown again, and now include an unfinished slab 14 of freshly poured concrete. It is important to note that above each flange 16 is a thin layer 18 of concrete. Flange 16 is representative of those parts of a metal column 10 which will be employed in joining column 10 to an upward extension thereof. Flange 16 will therefore be understood to encompass dowels, threaded fasteners, rivets, holes for accepting the aforementioned attachment devices, and the like.

Figure 3:
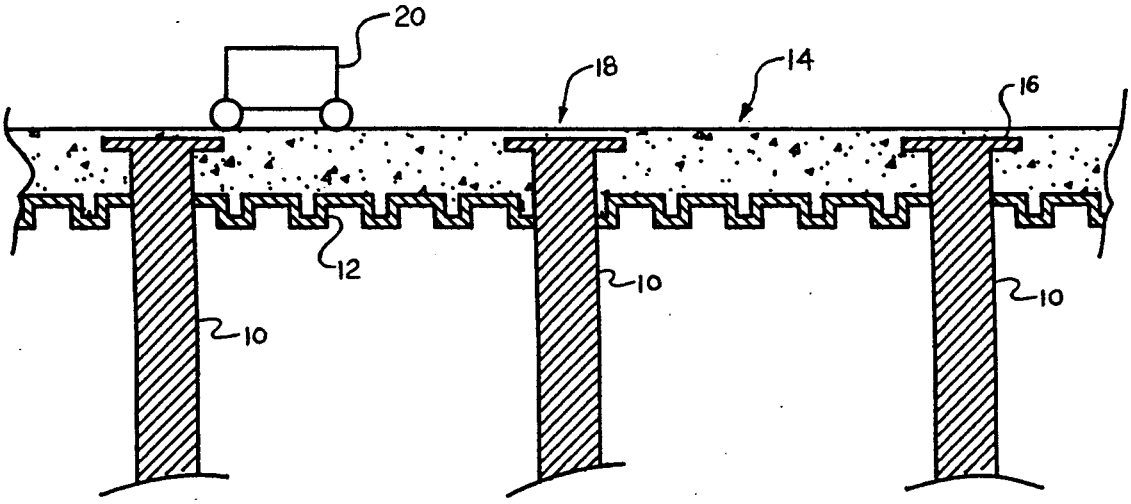
FIG. 3 shows the elements of FIG. 2, further illustrating screeding operations.

One advantage accruing from thin layer 18 is seen in FIG. 3. A screeding machine 20 of any well known type may be supported on rails or other solid members (not shown) at the perimeter of slab 14, and finishes slab, 14 as it is wheeled fore or aft.

Figure 4:
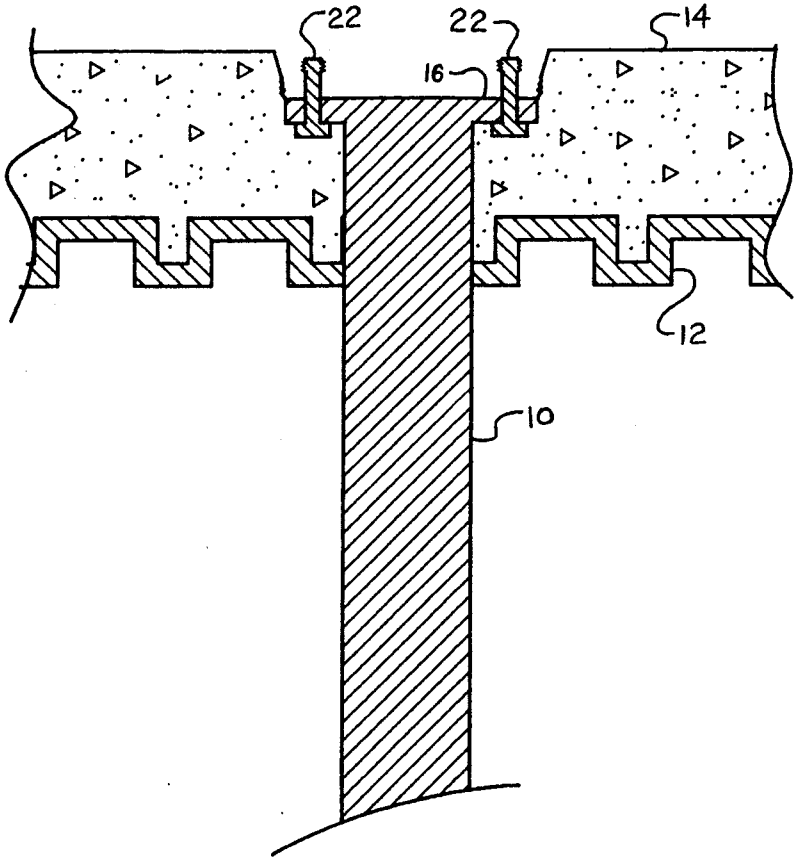
FIG. 4 is a diagrammatic, side cross sectional detail view taken at any column illustrated in FIG. 2, showing additional detail of the column and removal of concrete therefrom, drawn to enlarged scale.

After a short period of time, perhaps as little as several hours, depending upon the characteristics of the concrete mix selected, workers (not shown) will be able to walk on slab 14. They will readily discern areas occupied by thin layers 18 by coloration differences between thin and thick portions of slab 14. When sufficiently cured, these thin layers 18 are chipped away, as seen in FIG. 4.

Flange 16 is then exposed, and fasteners, such as bolts 22, are exposed and cleaned as required. Bolt 22, in this embodiment, must be set in place prior to the pour.

Figure 5:
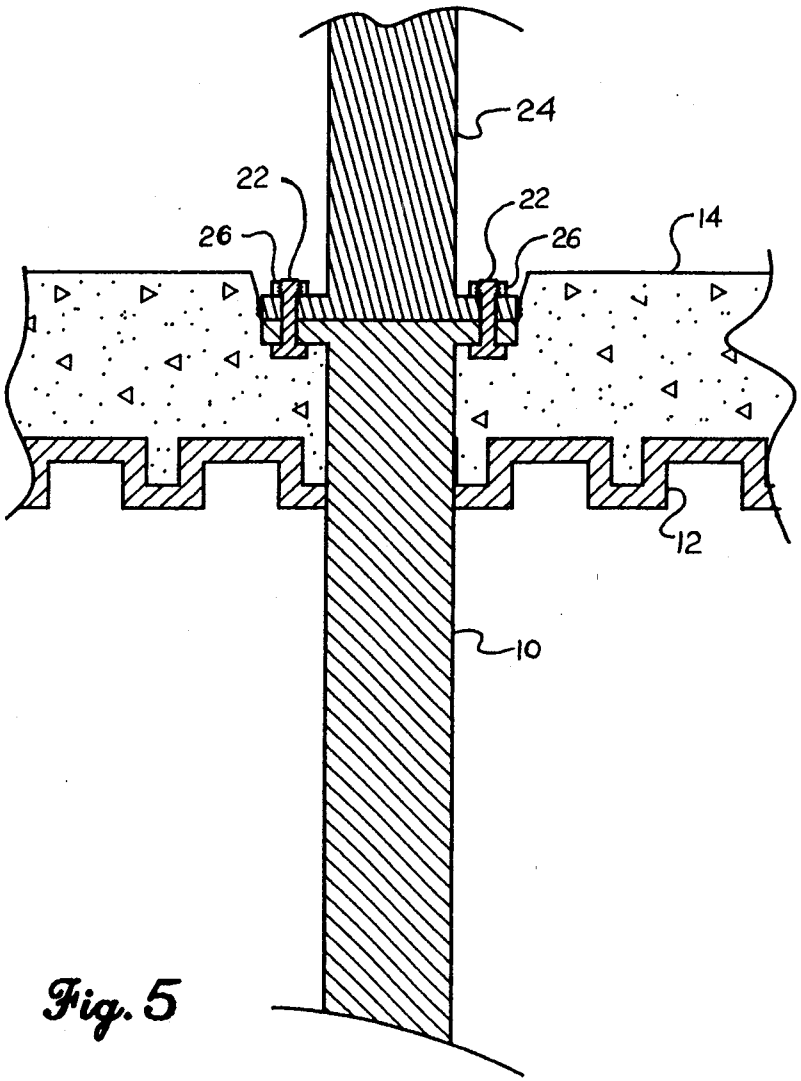
FIG. 5 is the view of FIG. 4, showing extension of the column, drawn to enlarged scale.

As shown in FIG. 5, an extending member 24 is set in place on column 10, and fastened, as represented by nuts 26. If desired, the slab upper surface can be patched or otherwise concealed or finished. Regardless, all columns 10 are similarly extended upwardly to the next story, level or floor. A new metal sheet 12 or form is erected, and the process is repeated until the structure's predetermined number of floors is complete.

Figure 6:
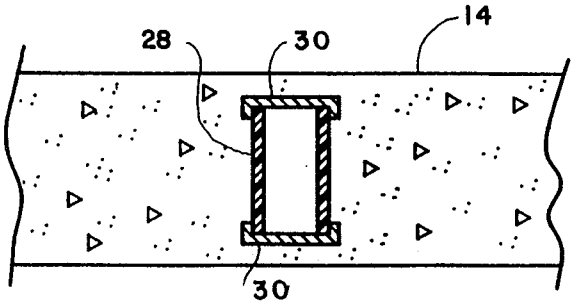
FIG. 6 is a diagrammatic, side cross sectional detail view of a slab penetrating member, truncated and capped according to the novel method, drawn to enlarged scale.

Because even small obstructions will defeat successful operation, all members which would otherwise penetrate slab 14 are terminated below the upper surface thereof. As seen in FIG. 6, a sleeve 28 for leaving a slab penetration is illustrated. Sleeve 28 is provided with caps 30 for excluding concrete therefrom. Although indicated as being metal, caps are preferably made from a material which is readily frangible or otherwise easily removed.

Again, a thin layer 18 of concrete is formed above upper cap 30. After curing, this thin layer 18 is discerned and removed, thus exposing sleeve 28. The penetration will be utilized after caps 30 are removed. It is to be understood that sleeve 28 is representative of all non-structural members which may be required to penetrate slab 14, such as airways, electrical or plumbing apparatuses, or still other devices. Likewise, columns 10 are representative of all structural members having a vertical component, regardless of whether the actual orientation of the structural member is truly vertical.

Figure 7:
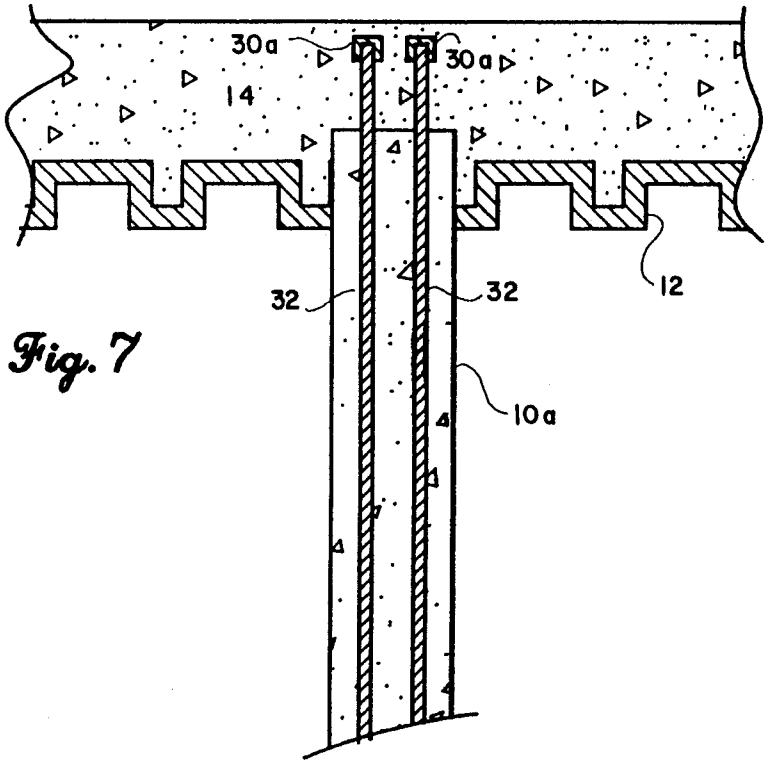
FIG. 7 is a diagrammatic, side cross sectional detail view corresponding to FIG. 2, but illustrating a second embodiment of the novel method, applied to concrete rather than steel columns, and drawn to enlarged scale.

Vertical columns may be of the poured concrete type as well as the structural steel members depicted in FIGS. 1–5. This is shown in FIG. 7, wherein an alternative embodiment of the invention is disclosed. In FIG. 7, conventional rebars 32 extend from column 10A. Where desired, caps 30A are provided to assure exposed ends free of concrete, as for welding rebar extensions thereto for extending column 10A.

Figure 8:
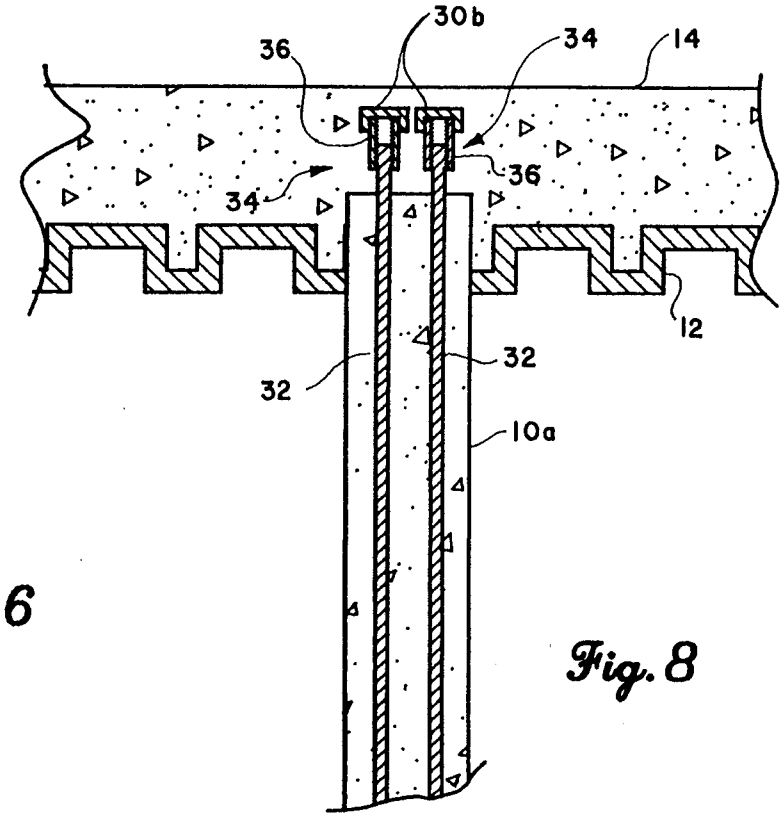
FIG. 8 is a diagrammatic, side cross sectional detail view similar to FIG. 7, but illustrating a third embodiment of the novel method, and drawn to enlarged scale.

In still another alternative embodiment, as shown in FIG. 8, rebars 32 may be provided with connecting apparatus, in this case threading 34, which cooperates with a special connector, such as threaded sockets 36. Again, it is preferable that caps 30B be provided to exclude concrete. After removal of thin layer 18, studs, sockets, or threaded rebar (none shown) will be employed to extend rebar so that a subsequent section of column 10A may be poured therearound.

Figure 9:
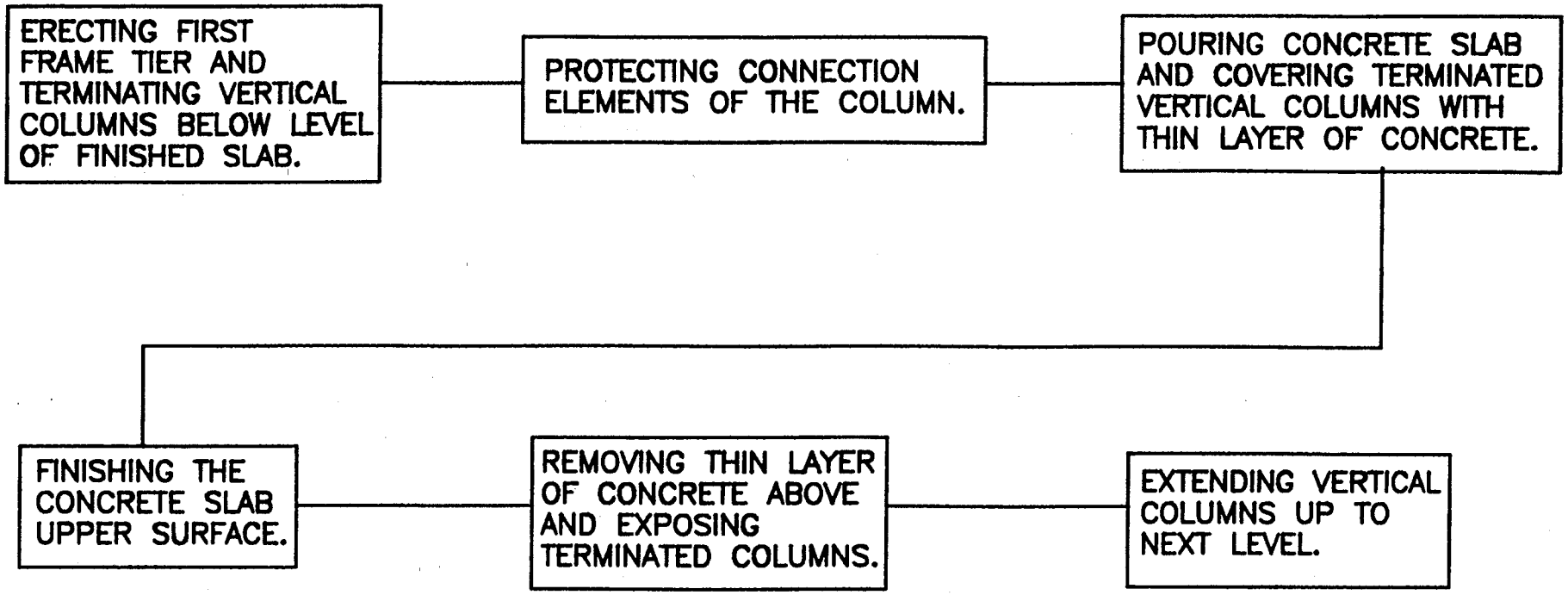
FIG. 9 is a block diagram summarizing steps of the novel method, and is read starting from the upper left.

The significant steps of the novel method are summarized in FIG. 9. Obviously, a first tier of columns is erected, and so designed that they terminate below the level of the finished slab. Appropriate protection, such as caps 30, 30A, or 30B are placed on column flanges or other connection elements thereof.

The slab is then poured and distributed in any suitable fashion, leaving a relatively thin layer of concrete above the columns and penetrating members. The slab is then finished, this preferably comprising method or apparatus which takes advantage of the unobstructed slab upper surface, such as is provided by a full width screeding machine which completes the finishing operation in a single pass.

In the final steps, the structural members are exposed and extended in a fashion appropriate for the building being constructed. Since this method requires a screeding machine, scaffolding to support the same, and other complications, it is likely that the most advantageous application of the novel method will be for building having many floors. In such cases, the basic steps set forth above are repeated to complete the building.

Thus it will be seen that the novel method is useful with the major types of columns employed for supporting multistory buildings.

It is to be understood that the present invention is not limited to the embodiments described above, but encompasses any and all embodiments within the scope of the following claims.

I claim:

1. A method of constructing a building comprising the steps of:
   a) erecting a first tier of vertical columns having upper terminal portions, said tier including horizontal retaining elements joining said vertical columns adjacent said terminal portions;
   b) forming a concrete slab by pouring concrete into said retaining elements sufficiently deep to cover said upper terminal portions of said vertical columns with a thin layer of concrete;
   c) finishing said concrete slab;
   d) removing the thin layer of concrete to expose said upper terminal portions of said vertical columns; and
   e) extending said vertical columns to erect a second tier of vertical columns.

2. The method according to claim 1, wherein the step of finishing said concrete slab is performed by employing a screeding machine which finishes said concrete slab in a single pass.

3. The method according to claim 1, wherein said upper terminal portions of said vertical columns include connection elements which are protected before forming said concrete slab.

4. The method according to claim 1, wherein the steps a)–e) are repeated until the structure under construction includes a predetermined number of floors.

5. The method according to claim 4, wherein the predetermined number of floors includes at least two floors.

6. The method according to claim 5, wherein the at least two floors are above grade.

7. The method according to claim 1, further including the steps of:
   f) erecting slab penetrating members having upper terminal portions before forming said concrete slab, such that when the concrete is poured into said retaining elements said upper terminal portions of said slab penetrating members are covered with a thin layer of concrete; and
   g) removing the thin layer of concrete to expose said upper terminal portions of said slab penetrating members after forming said concrete slab.

8. A method of constructing a building comprising the steps of:
   a) erecting a first tier of vertical columns having upper terminal portions, said tier including horizontal retaining elements joining said vertical columns adjacent said terminal portions;
   b) forming a concrete slab by pouring concrete into said retaining elements sufficiently deep to cover said upper terminal portions of said vertical columns with a thin layer of concrete;
   c) finishing said concrete slab by employing a screeding machine which finishes said concrete slab in a single pass;
   d) removing the thin layer of concrete to expose said upper terminal portions of said vertical columns; and e) extending said vertical columns to erect a second tier of vertical columns.

9. The method according to claim 8, wherein said upper terminal portions of said vertical columns include connection elements which are protected before forming said concrete slab.

10. The method according to claim 8, wherein the steps a)–e) are repeated until the structure under construction includes a predetermined number of floors.

11. The method according to claim 10, wherein the predetermined number of floors includes at least two floors.

12. The method according to claim 11, wherein the at least two floors are above grade.

13. A method of constructing a building comprising the steps of:

a) erecting a first tier of vertical columns having upper terminal portions, said tier including horizontal retaining elements joining said vertical columns adjacent said terminal portions;

b) forming a concrete slab by pouring concrete into said retaining elements sufficiently deep to cover said upper terminal portions of said vertical columns with a thin layer of concrete;

c) finishing said concrete slab by employing a screeding machine which finishes said concrete slab in a single pass;

d) removing the thin layer of concrete to expose said upper terminal portions of said vertical columns;

e) extending said vertical columns to erect a second tier of vertical columns; and f) repeating steps a), b), c), d), and e), until the building under construction includes at least two floors above grade.

14. The method according to claim 13, wherein said upper terminal portions of said vertical columns include connection elements which are protected before forming said concrete slab.

15. The method according to claim 13, further including the steps of:

g) erecting slab penetrating members having upper terminal portions before forming said concrete slab, such that when the concrete is poured into said retaining elements said upper terminal portions of said slab penetrating members are covered with a thin layer of concrete; and h) removing the thin layer of concrete to expose said upper terminal portions of said slab penetrating members after forming said concrete slab.

* * * * *